US005456189A

United States Patent [19]

Belle Isle

[11] Patent Number: 5,456,189

[45] Date of Patent: Oct. 10, 1995

[54] SHIPPING PALLET

[75] Inventor: Richard Belle Isle, Deerfield Beach, Fla.

[73] Assignee: Cellular Technology Inc., Deerfield Beach, Fla.

[21] Appl. No.: 132,177

[22] Filed: Oct. 6, 1993

[51] Int. Cl.[6] ..... B65D 19/00

[52] U.S. Cl. ..... 108/51.1; 108/902

[58] Field of Search ..... 108/901, 902, 108/51.1, 56.1, 56.3, 54.1

[56] References Cited

U.S. PATENT DOCUMENTS

| | | | |
|---|---|---|---|
| 1,772,736 | 8/1930 | Romine | 108/51.1 |
| 2,643,081 | 6/1953 | Spring | 248/129 |
| 2,930,560 | 3/1960 | Carnwath | 248/120 |
| 2,971,768 | 2/1961 | Ackley . | |
| 3,267,884 | 8/1966 | Lessheim . | |
| 3,316,861 | 5/1967 | Pailey | 108/901 X |
| 3,342,146 | 9/1967 | Lessheim | 108/901 X |
| 3,812,792 | 5/1974 | LaBelle . | |
| 3,878,796 | 4/1975 | Morrison | 108/56 |
| 3,971,326 | 7/1976 | Svirklys | 108/56.1 |
| 4,316,919 | 2/1982 | Cupido | 108/902 X |
| 4,350,099 | 9/1982 | Dersson | 108/56.1 |
| 4,359,948 | 11/1982 | Judy | 108/56.1 |
| 4,382,414 | 5/1983 | Svirklus | 108/56.1 |
| 4,597,339 | 7/1986 | McCaffrey et al. | 108/51.1 |
| 4,993,330 | 2/1991 | Yen . | |
| 5,101,737 | 4/1992 | Gomez | 108/51.1 |
| 5,170,722 | 12/1992 | Friesner . | |

FOREIGN PATENT DOCUMENTS

| | | | |
|---|---|---|---|
| 31098 | 12/1960 | Finland | 108/56.1 |
| 9113810 | 9/1991 | WIPO | 108/901 |

*Primary Examiner*—Jose V. Chen

*Attorney, Agent, or Firm*—Shlesinger, Arkwright & Garvey

[57] ABSTRACT

A plastic pallet comprises a plurality of longitudinal spaced apart and parallel base members; a plurality of longitudinal spaced apart and parallel cross-members disposed transversely over the base members; and a plurality of compression cups or cylinders for snapping the components together. The base and cross-members are extruded polyvinylchloride. Each of the base member has a substantially "I"-beam cross-section with a web portion disposed between substantially trapezoidal upper and lower flange portions. The base and cross-members each includes a plurality of longitudinal openings for making the pallet lightweight and rigid.

14 Claims, 2 Drawing Sheets

SHIPPING PALLET

FIELD OF THE INVENTION

The present invention relates generally to a recirculating pallet as opposed to a general purpose shipping pallet and in particular to a shipping pallet made from recyclable polyvinylchloride plastic material.

BACKGROUND OF THE INVENTION

This application is related to Disclosure Document No. 338,561 filed on Aug. 23, 1993 and Disclosure Document No. 339,586 filed on Sep. 21, 1993.

Pallets are typically made of wood and are used for supporting various items for ease of handling by a fork lift truck or the like for transport within a plant or warehouse or to another location. Wood pallets are typically heavy and bulky, thereby discouraging re-use by being shipped back to the shipper of goods for which the pallets were used. Thus, most wood pallets, while still in good condition, end up being discarded in the dumps, thereby contributing to the exhaustion of relatively scarce dump facilities around the country. Wood pallets are susceptible to easy breakage when being handled by forklifts during usage. Once broken, repair is normally not done, since labor is expensive. Thus, broken pallets certainly end up in the dump sites around the country.

Pallet users are therefore moving toward using plastic pallets instead of wood pallets. For example, the Federal Government perceives plastic pallets as environmentally preferable to wood pallets and is considering requiring plastic pallets in its procurement of products.

The present invention is directed to meeting the demand for plastic pallets that would solve the problems associated with wood pallets.

OBJECTS AND SUMMARY OF THE INVENTION

It is an object of the present invention to provide a pallet made entirely of recyclable plastic material, such as polyvinyl chloride, that will not disintegrate, rot, splinter, crack, delaminate and will not support combustion, bacteria or fungus growth.

It is another object of the present invention to provide a plastic pallet using snap-together construction rather than assembly by metal fasteners such as bolts, nuts, screws, nails, staples or the like as typically used for wood pallet construction, thereby saving on labor cost.

It is still another object of the present invention to provide a plastic pallet whose component parts are made by extrusion and cut to any desired length, thereby permitting to form any desired sized pallet.

It is still another object of the present invention to provide a plastic pallet that would have relatively long life cycle, reduces substantially the pallet shipping weight as compared to wood pallets and uses materials that are practically 100% recyclable.

It is another object of the present invention to provide a plastic pallet made from recyclable polyvinylchloride material.

It is another object of the present invention to provide plastic pallets that are collapsible to smaller volume and nestable with each other for returning to the shipper.

It is still another object of the present invention to provide a pallet that can be manufactured without any expensive molds or tooling to any transportable size as compared to an injection molded plastic pallet which is limited by the size of its mold and can only produce one size.

This and other objects of the present invention will become apparent from the following detailed description.

BRIEF DESCRIPTIONS OF THE DRAWINGS

DETAILED DESCRIPTION OF THE INVENTION

Figure 1:
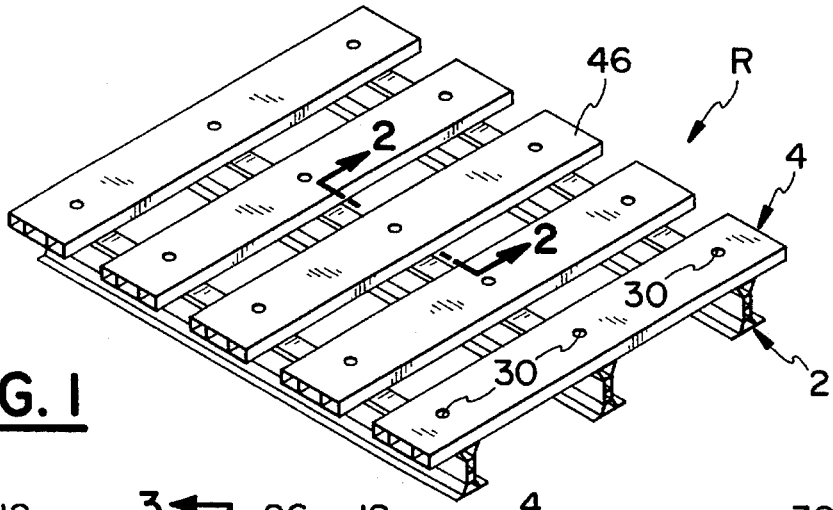
FIG. 1 is a perspective view of a pallet in accordance with the present invention.

A pallet R in accordance with the present invention is disclosed in FIG. 1. The pallet R comprises a plurality of hollow spaced apart and parallel base members or rails 2 and a plurality of hollow spaced apart and parallel cross-members 4 that are disposed transversely to the base members 2. The base members 2 and cross-members 4 are preferably made from extruded polyvinylchloride (PVC) plastic. PVC is recyclable, relatively more durable than wood, has a relatively long life cycle, and reduces the pallet shipping weight substantially. PVC is practically 100% recyclable. Fabricating the base members 2 and the cross-members 4 by extrusion advantageously avoids the cost of expensive tooling, such as molds used in injection molding, and advantageously permits the component parts to be made to any size length.

Figure 3:
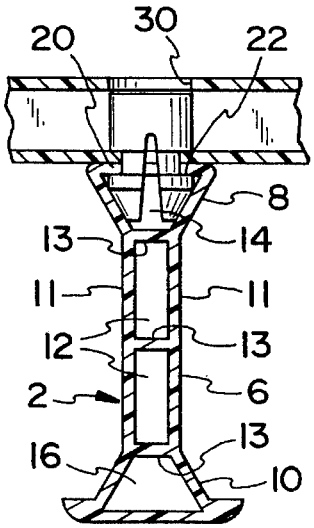
FIG. 3 is a cross-sectional view taken along line 3—3 of FIG. 2.
Figure 4:
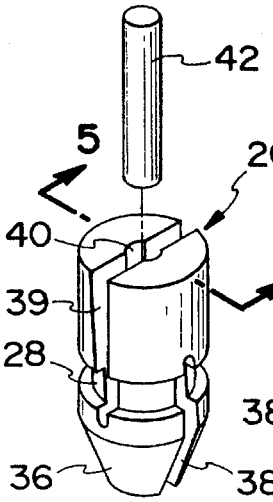
FIG. 4 is a perspective view of a slotted cylinder used in the present invention to secure the component parts of the pallet of FIG. 1.
Figure 5:
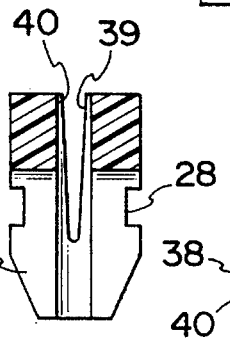
FIG. 5 is a cross-sectional view taken along line 5—5 of FIG. 4.
Figure 6:
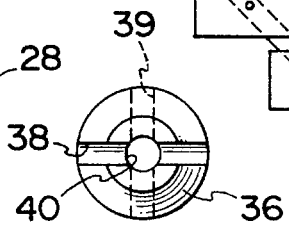
FIG. 6 is a bottom view of FIG. 5.

Each of the base members 2 has an "I"-beam configuration, with a web portion 6 disposed between an upper flange portion 8 and a lower flange portion 10, as best shown in FIG. 3. The web portion 6 is substantially rectangular in shape with a pair of parallel walls 11 supported by a plurality of ribs 13, thereby defining a plurality of openings 12 traversing the length thereof. The upper flange portion 8 is substantially trapezoidal in shape with a trapezoidal opening 14 traversing the length thereof. The lower flange portion 10 is substantially trapezoidal in shape with a trapezoidal opening 16 traversing the length thereof. Each cross-member 2 therefore provides a lightweight and rigid structure.

Figure 2:
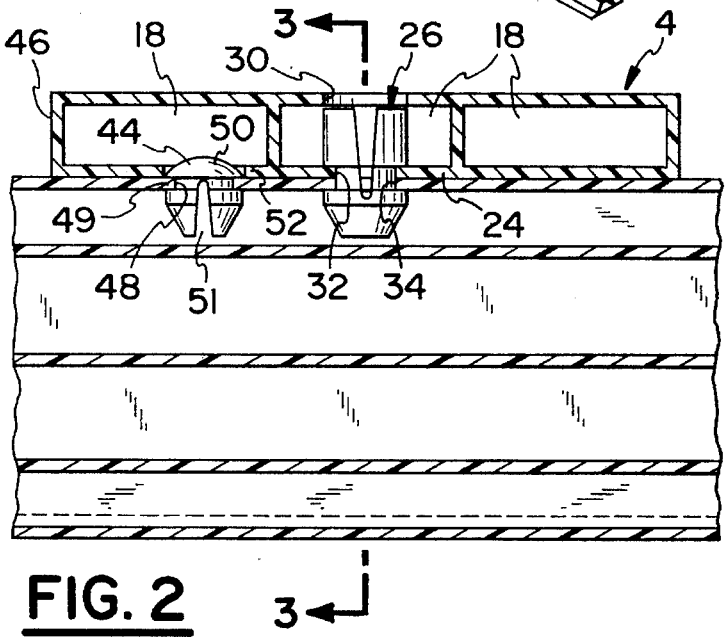
FIG. 2 is a cross-sectional view taken along line 2—2 of FIG. 1.

Each of the cross-members 4 is substantially rectangular in cross-section, with a plurality of openings 18 running through the length thereof, as best shown in FIG. 2. Each cross-member 2 is therefore lightweight and rigid.

Because the component parts of the pallet R are hollow, substantial savings in weight is advantageously achieved. For example, the pallet R with five 48 inch long cross-members and three 40 inch long base members would weigh approximately twenty-two pounds as compared to forty-five pounds for a wood pallet of the same design.

The upper flange portion 8 has a support member 20 with a thickness 22. The cross-member 4 has a material thickness 24 at the location where it is secured to the base member 2, as best shown in FIG. 2.

The cross-members 4 are secured to the base members 2 by means of a plurality of slotted and tapered cylinders 26 at each point where a cross-member rests over a 10 base member, as best shown in FIGS. 2 and 3. Each cylinder 26 has a circumferential slot 28 disposed intermediate its ends that is adapted to receive the thicknesses 22 and 24 of the base members 2 and cross-members 4 at the places of securement, as best shown in FIG. 2. Each of the cross-members 4 has a plurality of holes 30 that are adapted to receive each cylinder 26 at each place of securement with the corresponding base member 2. A plurality of holes 32 are each disposed directly below each opening 30. Each hole 32 has a diameter substantially equal to the diameter of the slot 28 of the cylinder 26. A plurality of holes 34 in each base member 2 have the same diameter as the hole 32. Each hole 34 is disposed directly underneath and in alignment with each hole 32, as best shown in FIGS. 2 and 3.

Each cylinder 26 has a tapered forward end 36 and diametrical and longitudinal tapered slots 38 and 39 that are disposed transversely to each other such that the forward end 36 of the cylinder 26 may be collapsed in two transverse directions to force it into the holes 32 and 34 and thereby lock the respective cross-member 4 and base member 2 in the circumferential slot 28. The bottom of the slots are advantageously rounded for stress relief. The cylinder 26 is guided through the hole 30 and into the holes 32 and 34, as best in shown in FIG. 2. A central tapered bore 40 is disposed through the cylinder 26 and is adapted to receive a pin 42 after the cylinder 26 has been positioned into the holes 32 and 34 to thereby lock it in place. The bore 40 tapers from wide to narrow into the cylinder 26. The diameter of the pin 42 is roughly the diameter of the larger portion of the tapered bore 40 such that as the pin is driven into the bore, the pin 42 will spread the slot 38 apart. The pin 42 is preferably molded PVC.

Figure 7:
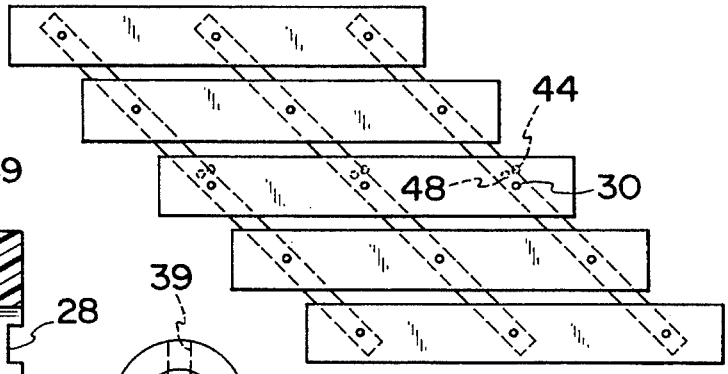
FIG. 7 is a top plan view of FIG. 1 shown in collapsed form.

A crowned detent 44 is disposed in each of the cross-members 2 underneath the central cross-member 46, as best shown in FIG. 2. Each detent 44 is snap-fitted into an opening 48 on the support member 22 of the base member 2 such that a circumferential slot 49 receives the thickness of the support member 20. Each detent 44 has a tapered end and a diametrical and axial slot 51 to advantageously aid in seating the detent body in the hole 52. The slot 51 has a radiused bottom for stress relief. Each detent 44 has a crowned head 50 that is received within a corresponding hole 52 in the cross-member 46, as best show in FIG. 2. Each detent 44 when aligned and received within the opening 52 locks the cross-members of 4 in the rectangular position as best show in FIG. 1. The cross-members 4 have enough resiliency to ride over the each crowned head 50 when inwardly diagonal pressure from opposite corners of the pallet R is applied, allowing the pallet R to obtain collapse into a parallelogram shape, as best shown in FIG. 7. The pallet R in the collapsed form may be advantageously nested to another collapsed pallet, thereby saving space when shipping the pallet R back to the shipper of goods. Two pallets may be nested together by inverting one pallet face down and fitting the base members between each other.

The pallet R in the collapsed shape of a parallelogram advantageously reduces the shipping cube of the pallet by approximately 33%, thereby reducing the freight for shipping the pallets to the original shipper for reuse. Two pallets that are nested into each other with one pallet face down and then collapsed into the parallelogram shape will occupy roughly ¾ the space of two fully set up and nested two-faced pallets.

Figure 8:
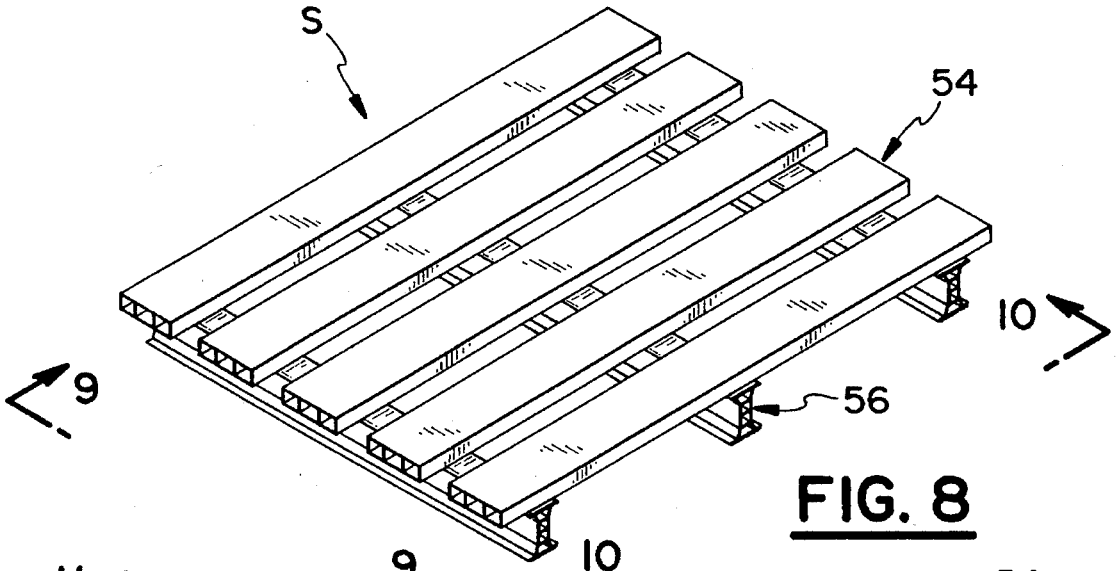
FIG. 8 is a perspective view of another embodiment of a pallet made in accordance with the present invention.
Figure 9:
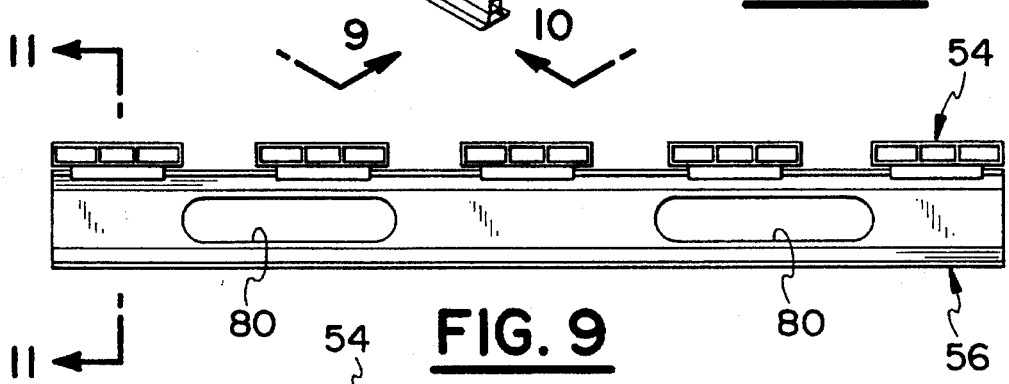
FIG. 9 is a view taken along line 9—9 of FIG. 8.
Figure 10:
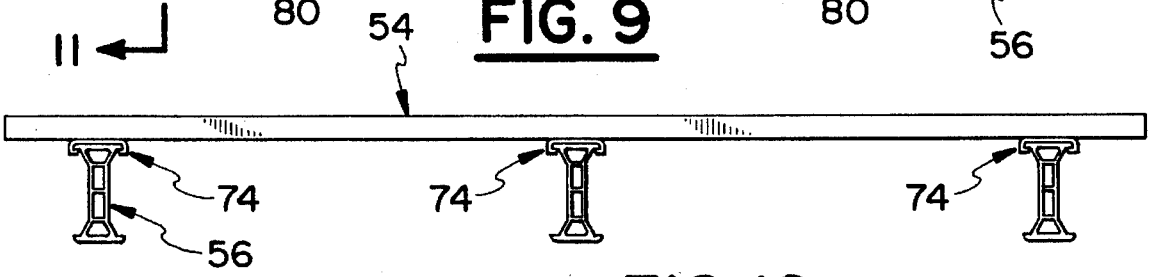
FIG. 10 is a view taken along line 10—10 of FIG. 8.
Figure 11:
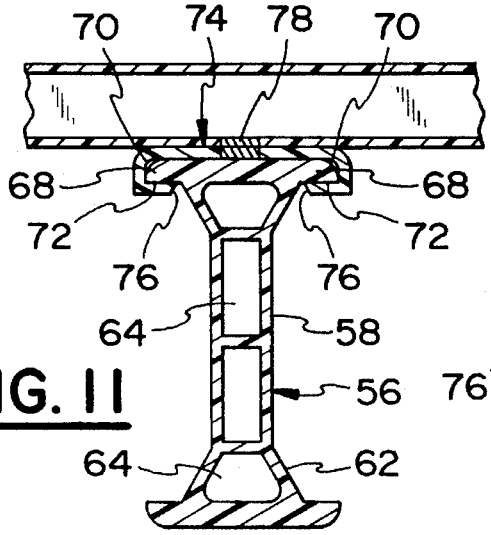
FIG. 11 is a cross-sectional view taken along line 11—11 of FIG. 9.

Another embodiment of the present invention is disclosed as pallet S, as best shown in FIG. 8. The pallet S comprises a plurality of spaced apart and parallel cross-members 54 disposed transversely to a plurality of spaced apart and parallel base members 56. The cross-members 54 and base members 56 are preferably extruded PVC plastic, as in the pallet R. Each base member 56 is in the shape of a "I"-beam, with a web portion 58 disposed between upper and lower flange portions 60 and 62, respectively, as best shown in FIG. 11. Each base member 56 has a plurality 64 of openings running through the length thereof, thereby making the base members 56 lightweight and rigid. The upper and lower flange portions 60 and 62 are substantially trapezoidal in shape. The upper flange portion 60 has a support member 66 with outwardly extending edge portion 68 with outwardly and downwardly rounded edges 70 and substantially horizontal under surfaces 72, as best shown in FIG. 11. Each cross-member 54 is secured to the base members 56 by means of a plurality of compression cups 74 that are secured to the underside of each cross-member 54 at the places of support with the base members 56, as best shown in FIGS. 10 and 11.

Figure 12:
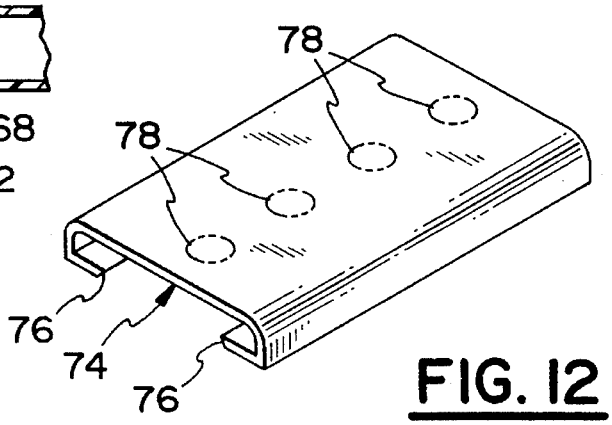
FIG. 12 is a top perspective view of a clip used in the present invention to secure the components of the pallet of FIG. 8.

Each cup 74 is substantially "C"-shaped in cross-section with beveled edges 76, as best shown in FIGS. 11 and 12. Each cup 74 is preferably made of PVC and has enough resiliency to snap in place around the support member 66 when pressed from above. The tapered edges 76 is preferably at 30° with respect to the vertical. Each cup 74 is preferably ultra-sonically welded to the underside of the respective cross-members 54 at locations generally indicated at 78, as best shown in FIGS. 11 and 12. Other conventional securing means may be used.

The interior cross-sectional profile of each cup 74 is adapted to friction fit over the exterior profile of the support member 66 thereby to secure each cross-member 54 to the respective base member 56.

The pallet S is shipped to the user in a nested position, whereby a second pallet is inverted faced down and its base members interfitted between the base members of the pallet above it. The pallet S can also be shipped knocked down and the user would simply snap the compression cups 74 secured to the cross-members 54 into the base members 56.

For shipping back to the origin after the goods or items have been unloaded from the pallet, the pallet S may be shipped knocked-down. Since the cross-members 54 are held in place to the base members 56 by friction, an application of sufficient force on the cross-members by the user along the longitudinal axes of the cross-members would cause the cross-members 54 to slip along the base members 56 until they are disengaged at the ends of the base members.

Each base members 2 and 56 have openings 80 to provide access for forks of lift trucks or pallet jacks (not shown) and therefore have four way entry capability.

During use, any damaged component can be easily replaced and the damaged component recycled.

The cross-members and base members of pallets R and S may be of any color to designate, for example, different products or load capacities. Pertinent data, such as logo, name, etc., may also be thermally formed into the pallet components.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A plastic pallet comprising:

a) a plurality of longitudinal spaced apart and parallel base members;

b) a plurality of longitudinal spaced apart and parallel cross-members disposed transversely over said base members such that each of said cross-member is associated with said base members disposed underneath;

c) each of said cross-members and said base members disposed below having abutting portions, each of said abutting portions including cooperating holes;

d) a plurality of cylinders each having a diametrical slot disposed from its forward end to its intermediate portion to permit said cylinders to be forced into respective abutting holes;

e) each of said cylinders including a circumferential slot at its intermediate portion; and f) each of said holes including edge portions adapted to be disposed within said circumferential slot such that each of said abutting portions are locked together, thereby to secure each of said cross-members to said base members.

2. A plastic pallet as in claim 1, wherein:

a) said base and cross-members are extruded.

3. A plastic pallet as in claim 1, wherein:

a) each of said base members has a substantially "I"-beam cross-section having a web portion disposed between substantially trapezoidal upper and lower flange portions.

4. A plastic pallet as in claim 3, wherein:

a) each of said web portions has a pair of parallel spaced apart walls and a plurality of ribs disposed between said walls.

5. A plastic pallet as in claim 3, wherein:

a) said upper and lower flange portions each includes a substantially trapezoidal longitudinal opening.

6. A plastic pallet as in claim 1, wherein:

a) said base and cross-members are made from polyvinylchloride plastic.

7. A plastic pallet as in claim 1, wherein:

a) said cross-members are hollow.

8. A plastic pallet as in claim 1, wherein:

a) said slot is tapered from wide to narrow from the forward end of said cylinder to its intermediate portion.

9. A plastic pallet as in claim 1, wherein:

a) said cylinder includes a central tapered bore; and b) a pin adapted to be forced into said tapered bore such that said cylinder is expanded.

10. A plastic pallet as in claim 1, wherein:

a) said cylinder is molded polyvinylchloride plastic.

11. A plastic pallet as in claim 1, wherein:

a) said cross-members are pivotable about said cylinders, thereby to collapse said pallet into a substantially parallelogram shape.

12. A plastic pallet as in claim 11, and further comprising:

a) means for locking said cross-members to said base members at transverse positions.

13. A plastic pallet as in claim 12, wherein:

a) said locking means includes a plug secured to one of said base members; and b) said plug includes a crowned head projecting above a surface of said one base member and cooperates with an opening in said one cross-member.

14. A plastic pallet as in claim 1, wherein a) said base and cross-members each includes a plurality of longitudinal openings.

* * * * *